United States Patent [19]

Uerpmann et al.

[11] 4,326,820

[45] Apr. 27, 1982

[54] FINAL DEPOSITORY FOR RADIOACTIVE WASTES

[75] Inventors: Ernst-Peter Uerpmann, Osterode; Gerhard Staupendahl, Clausthal-Zellerfeld; Manfred Schmidt, Goslar, all of Fed. Rep. of Germany

[73] Assignee: Gesellschaft für Strahlen-und Umweltforschung mbH München, Neuherberg, Fed. Rep. of Germany

[21] Appl. No.: 964,140

[22] Filed: Nov. 28, 1978

[51] Int. Cl.[3] ..... E21F 17/16; G21F 9/24

[52] U.S. Cl. ..... 405/128; 252/633; 405/53

[58] Field of Search ..... 405/53, 55, 59, 132, 405/133, 128, 129; 176/37, 87; 252/301.1 W

[56] References Cited

U.S. PATENT DOCUMENTS

| | | | |
|---|---|---|---|
| 2,661,062 | 12/1953 | Edholm | 405/59 |
| 2,934,904 | 5/1960 | Hendrix | 405/59 |
| 3,643,426 | 2/1972 | Janelid | 405/59 X |
| 3,925,992 | 12/1975 | Bäckström | 405/53 |

FOREIGN PATENT DOCUMENTS

| | | | |
|---|---|---|---|
| 2755554 | 6/1978 | Fed. Rep. of Germany | 405/128 |
| 7602753 | 3/1976 | Netherlands | 252/301.1 W |

OTHER PUBLICATIONS

George: "Treating and Disposing of Radioactive Wastes," Chemical Engineering, Dec. 14, 1959, pp. 151–159.

Schneider: "Solidification of Radioactive Wastes," Chemical Engineering Progress, Feb. 1970, pp. 35–41.

*Primary Examiner*—David H. Corbin

*Attorney, Agent, or Firm*—Spencer & Kaye

[57] ABSTRACT

A final depository located underground for storing radioactive wastes contained in storable shielded containers, composed of at least one shaft extending downwardly from the ground surface, an underground passage, a radioactive waste storage region located above the underground passage, and a connecting passage connecting the storage region with the shaft or the underground passage.

9 Claims, 1 Drawing Figure

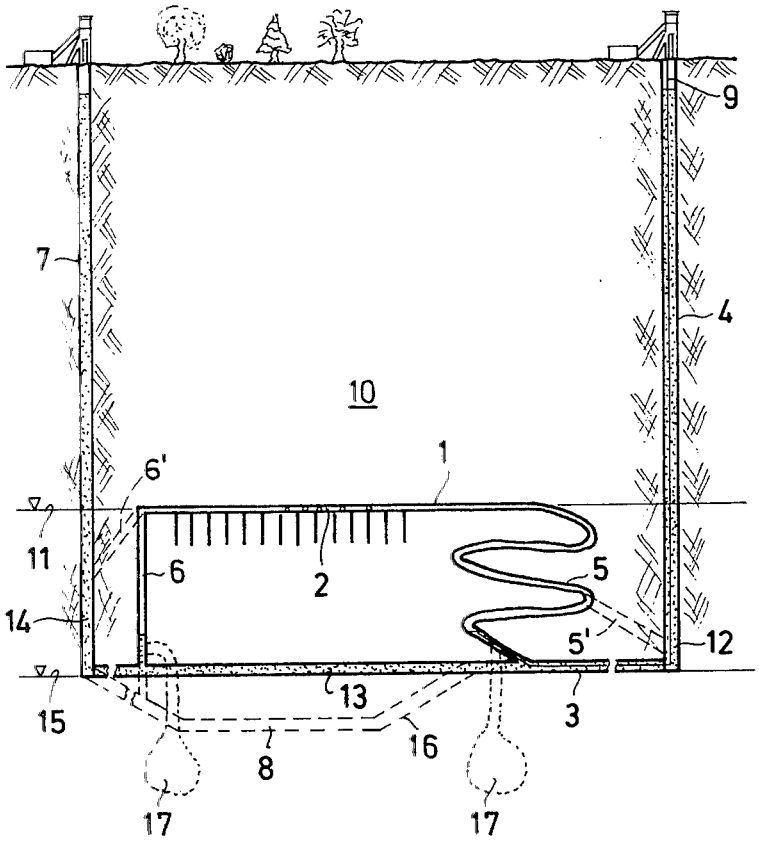
9
7
4
10
1
6'
11
6
2
5
14
5'
12
13
15
3
16
8
17
17

FINAL DEPOSITORY FOR RADIOACTIVE WASTES

BACKGROUND OF THE INVENTION

The present invention relates to a final depository for radioactive wastes in a salt stock or other equivalent geological formation, in which the wastes are housed in storable shielded containers and are retained in a section of the salt stock or equivalent formation.

All over the world, the storage of radioactive wastes in geological formations is considered to be the best method of keeping these materials, which will constitute a danger over millenia, safely away from inhabited regions of the earth. This exclusion from the biosphere must be effective until the radioactivity has decayed to harmless levels. Depending on the composition and type of the wastes, this requires time periods from a hundred years to several hundred thousand years.

When these wastes are stored in geological formations, flooding of the final depository with water leads to subsequent penetration of leached radioactivity into the groundwater, which constitutes the most dangerous path of propagation.

Attempts at solving this problem so far have been directed toward protecting the radioactive wastes as well as possible against leaching by water or aqueous solutions of natural salts. This is done with the use of high quality fixing materials such as glass, ceramic, bitumen, plastics and hydraulic binders. Additionally, storage chambers are sealed by means of salt and hydraulic binders and the interstices between waste barrels are filled with loose salt. Wastes introduced into bores are protected by plugs of various materials such as salt, cement or bitumen.

In all these cases, however, there must be considered, as constituting the greatest possible danger, a break-in of water in which part or all of the stored wastes come into direct contact with the penetrating aqueous solutions. It is then likely that a fraction of the stored radioactive material is leached out and is distributed, by convection and diffusion, over a more or less large area of the underground cavities. Under favorable conditions it is not impossible that parts of the contaminated salt solutions also come into contact, after a shorter or longer period of time, with the groundwater to be found at a shallower depth. This case would jeopardize and endanger the intended goal of final storage, i.e. long-term secure exclusion of the radioactivity from the biosphere.

Highly radioactive, heat developing wastes are stored in final depositories provided especially for this purpose which are designed according to the principle of conventional underground mines. The highly radioactive wastes contain approximately 99% of the activity that has to be permanently disposed of. Wastes which are embedded in a glass matrix are packed in stainless steel containers and permanently stored in bore holes.

There is presently no known technique for preventing, with certainty, wastes from coming into contact with water during or after their storage. According to the prior art concepts, connections with the level of the final depository are made horizontally and directly with air shafts via a tap at the same depth. Also under consideration is the possibility of the final depository filling with water during or after storage although there is only a very slight probability of such an event occurring. The direct, horizontal connection of the bottom of the final depository with the air shafts according to prior art concepts would favor propagation of the radioactivity due to convection.

It must be assumed that a water break-in, if it occurs at all, would take place through a tubular shaft into the area of covering layers containing groundwater. The tubular shaft is generally considered the most vulnerable portion of a final depository since here the water flows over its shortest path through groundwater conductors and the geological storage formation, e.g. rock salt. For that reason the greatest attention should be accorded in the future to a shaft design that is as permanently completely watertight as possible in such areas. If water should nevertheless break in, such water would flow to the lowest point in the shaft and flow from there into the horizontally branching bottom of the depository or portions of the depository.

The generation of heat in the highly radioactive wastes locally heats up the enclosing geologic formation. The salt solution which is under hydrostatic pressure could then penetrate the storage bores, attack the hot waste containers and leach out radioactivity. The high temperatures involved could also produce strong convection currents in the vertical bore holes. Differences in density then would cause the leachable activity to be distributed in a very short time over the entire horizontal portion of the final depository.

Due to the higher temperature of the salt solutions in the lowest portion of the final depository, movement of the radioactive nuclides will also be able to take place in a vertical direction through the tubular shafts of the final depository. It is thus possible that the radioactivity finally propagates to the level of the water entrance point and thus into the groundwater.

Active countermeasures to protect the stored wastes against contact with salt solutions do not exist in the present state of the art and are not conceivable with final depositories of prior art design.

SUMMARY OF THE INVENTION

It is an object of the present invention to provide a final depository for highly, medium, or weakly radioactive wastes so that these wastes are protected against contact with water safely, automatically and over long periods of time.

A further object of the invention is to stop, from above ground, the propagation of water into the regions outside the area of the direct water break-in or to block it off, respectively.

These and other objects are accomplished, according to the present invention, by arranging the depository for accommodating the wastes in such a manner that its level lies at a sufficient distance above the connecting section and connecting the depository section with the connecting section or with a shaft by means of at least one helical path ascending from the connecting section or from the shaft to the depository and/or by means of a blind shaft.

According to a further feature of the invention the connecting section between two shafts is given the form of a sink. It is of particular advantage to be able, in the case of danger, to introduce a gas into the depository section through pressurized lines.

The novel final depository according to the present invention permits secure sealing of stored wastes against contact with water or salt solutions. Moreover, it makes possible additional active countermeasures which can prevent the advance of liquid from the shaft region into the underground cavities, or even reverse it if a water break-in should occur. If water should break in from regions other than the immediate area of the shaft, which with appropriate, fault-free and crack-free safety zones around the immediate final storage area is much less likely to happen than would access of water through the tubular shaft, the present invention makes it possible to block broad sections of the final depository from access by liquids in such a case. This is done in that the entire storage field is broken up into separate partial depositories which are not connected with one another by any horizontal paths at the same level.

BRIEF DESCRIPTION OF THE DRAWING

The sole FIGURE is a simplified, pictorial view of a preferred embodiment of a depository according to the invention shown after having experienced a water break-in.

DESCRIPTION OF THE PREFERRED EMBODIMENTS

As can be seen in the FIGURE, shafts 4 and 7 required for operation of a final depository 10 extend much deeper than the level 11 of the actual storage field 2 and are disposed at a sufficiently safe distance from the fields of the storage area 2. Shafts 4 and 7, after a water break-in, contain columns of water 12 and 14 and are connected together by a horizontal tunnel or tunnels 3 each filled with a body of water 13. In the case of the greatest possible accident, an air bubble can be produced in the portion 1 of the final depository 10 used for final storage of highly radioactive wastes 2 with this air bubble being under the hydrostatic pressure of a column of water. This assures that the masses of water 12, 13 and 14 will have no direct access to the final storage regions 1. Experience has shown that rock salt formations in mountain ranges do not permit the penetration of gases.

The shafts 4 and 7 required for the final depository 10 are sunk to at some distance, e.g. about 200 m, below the actual final storage area for highly radioactive, heat developing wastes 2. Once these shafts 4 and 7 have been drilled to a depth of about 1000 m, filling stations and horizontal connecting tunnels, or sections, 3 are built. The actual storage field 1 is built about 200–300 m above level 15 of the bottom of sections 3 and is connected with the lower lying connecting sections 3 only by helical passages 5 and/or blind shafts 6 and/or with shafts 4 and 7 only by helical passages 5' and/or blind shafts 6''. In the case of a water break-in, the water masses 12, 13 and 14 will initially rise only into the lower portion of the mine structure and will compress the air disposed in region 1 and passages 5 and shafts 6 until the air pressure reaches the hydrostatic pressure of the column of water.

The additional quantity of air required to hold back the water masses 12, 13 and 14 can be forced in through pipelines 9 installed in shafts 4 and 7 and along sections 3 via above-ground compressor stations (not shown).

Due to the introduction of a gaseous phase, direct contact is prevented between the wastes 2 and the water masses 12, 13 and 14 penetrating into the final depository 10. The possibility of leaching and subsequent spreading of radioactivity is prevented dependably and for a long period of time.

As shown in dashed lines, the connecting sections 3 may be designed in such a manner that one or a plurality form a section 16 having a sink portion 8. This design has the advantage that it prevents with certainty that, for example, when there is a break-in of a large amount of water, the water will not first rise in the helical passage 5 or in the blind shaft 6, respectively. When such a break-in occurs, the sink 8 is filled first and the air or other gas forming the atmosphere of the depository remains in the final depository 1 or in its entrances 5 and 6 until the water mass 13 blocks the latter as well.

In the meantime, underground personnel can in any case leave the depository through one of the horizontal connecting passages. As shown by dotted lines in the FIGURE, further cavities 17 can be built from the helical passage 5 or from the blind shaft 6 which, in the case of a very rapid water break-in, initially receive the masses of water. The air discharged from these additional spaces escapes into the final storage area 1 and is there compressed. Thus even if all of the other above-ground compressors are malfunctioning, properly dimensioned cavities 17 will make it impossible to flood storage section 1.

In addition to this advantage, there also exist other technical possibilities for long-term security of the final depository 10 which in the prior art designs of final depositories were impossible. Through pipelines 9, which are installed as a precaution and which can be used during normal operation as cooling, fresh air or material transportation conduits, pasty filler masses can be pumped into the volume of air under pressure. Such pasty masses gradually solidify and finally result in a final depository 10 which is tightly sealed with solid masses even after an accidental water break-in.

In order to reduce the size of the air-filled areas at the level 11 of the final depository, the depository sections 1 may additionally be filled, if required, with weakly and medium radioactive wastes 2, e.g. in barrels.

It will be understood that the above description of the present invention is susceptible to various modifications, changes and adaptations, and the same are intended to be comprehended within the meaning and range of equivalents of the appended claims.

What is claimed is:

1. A final depository located underground for storing radioactive wastes contained in storable shielded containers, comprising: at least one shaft extending downwardly from the ground surface; an underground passage; a radioactive waste storage region located above said underground passage and presenting a dry, solid floor for supporting the wastes; and means defining at least one connecting passage extending downwardly from said storage region to at least one of said shaft and underground passage, said means causing all fluid communication with said storage region to be directed exclusively downwardly from said floor.

2. A structure as defined in claim 1 wherein said connecting passage is a blind shaft.

3. A structure as defined in claim 1 wherein said connecting passage is helical in form.

4. A structure as defined in claims 2 or 3 wherein said connecting passage is connected to said underground passage.

5. A structure as defined in claims 2 or 3 wherein said connecting passage is connected to said at least one shaft extending downwardly from the ground surface.

6. A structure as defined in claims 1, 2 or 3 wherein said depository is located in a salt stock or equivalent geological formation.

7. A structure as defined in claim 1 wherein there are two said shafts located at respectively opposite sides of said storage region, and said underground passage is connected between said shafts and has the form of a sink.

8. A structure as defined in claims 1 or 7 further comprising conduit means disposed for delivering a gas to said storage region.

9. A structure as defined in claims 1 or 7 further comprising conduit means disposed for delivering a sealing material from above ground to at least partly seal said storage region and said connecting passage upon termination of delivery of radioactive wastes to said storage region or subsequent to a water break-in.

* * * * *